US010689176B2

(12) United States Patent
Bellamah et al.

(10) Patent No.: US 10,689,176 B2
(45) **Date of Patent: *Jun. 23, 2020**

(54) RE-SEAL LABEL AND CONTAINER WITH RE-SEAL LABEL

(71) Applicant: Altria Client Services LLC, Richmond, VA (US)

(72) Inventors: Stephen Bellamah, Midlothian, VA (US); Scott A. Fath, Richmond, VA (US); Andrew Peeler, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/568,734

(22) Filed: Sep. 12, 2019

(65) Prior Publication Data

US 2020/0156843 A1 May 21, 2020

Related U.S. Application Data

(63) Continuation of application No. 16/193,112, filed on Nov. 16, 2018, now Pat. No. 10,450,120.

(51) Int. Cl.
*B65D 75/58* (2006.01)
*B65D 5/66* (2006.01)
(Continued)

(52) U.S. Cl.
CPC ..... *B65D 75/5838* (2013.01); *A24F 15/00* (2013.01); *B65D 5/66* (2013.01);
(Continued)

(58) Field of Classification Search
USPC ..... 206/264, 265, 268, 271, 273
See application file for complete search history.

(56) References Cited

U.S. PATENT DOCUMENTS 3,727,828 A 4/1973 Hall
3,996,945 A 12/1976 McDowell
(Continued)

FOREIGN PATENT DOCUMENTS

EP 0 873 858 A1 10/1998
EP 3009374 4/2016
(Continued)

OTHER PUBLICATIONS

Extended European Search Report dated Apr. 12, 2018 in corresponding European Patent Application No. 17196271.5-1016 (9 pages).
(Continued)

*Primary Examiner* — Jacob K Ackun
(74) *Attorney, Agent, or Firm* — Buchanan Ingersoll & Rooney PC

(57) ABSTRACT

In an example embodiment, a re-sealable label for covering an opening of a box includes a sheet of polymer material that includes a re-sealable adhesive on an underside thereof. A liner is adhered to the underside of the sheet of polymer material. The liner is configured to cover the opening and includes a foil layer and a paper layer. The sheet of polymer material includes a line of perforations wherein one or more of the perforations of the line of perforations include a rectilinear portion and a non-rectilinear portion.

11 Claims, 3 Drawing Sheets

(51) Int. Cl.
*B65D 85/10* (2006.01)
*A24F 15/00* (2020.01)
*B65D 65/14* (2006.01)

(52) U.S. Cl.
CPC ..... *B65D 65/14* (2013.01); *B65D 85/1027* (2013.01); *B65D 85/1045* (2013.01)

(56) References Cited

U.S. PATENT DOCUMENTS

| | | | |
|---|---|---|---|
| 4,293,068 | A | 10/1981 | Focke et al. |
| 4,300,676 | A | 11/1981 | Focke et al. |
| 4,375,260 | A | 3/1983 | Focke et al. |
| 4,555,027 | A | 11/1985 | Froom |
| 4,607,748 | A | 8/1986 | Focke |
| 4,712,689 | A | 12/1987 | Froom |
| 4,763,779 | A | 8/1988 | Focke et al. |
| 4,771,882 | A | 9/1988 | Lowe et al. |
| 4,942,961 | A | 7/1990 | Focke et al. |
| 5,018,625 | A | 5/1991 | Focke et al. |
| 5,022,950 | A | 6/1991 | Ingalls et al. |
| 5,080,227 | A | 1/1992 | Focke |
| 5,096,113 | A | 3/1992 | Focke |
| 5,158,664 | A | 10/1992 | Colgan et al. |
| 5,788,065 | A | 8/1998 | Focke |
| 5,914,165 | A | 6/1999 | Freedman |
| 6,000,539 | A | 12/1999 | Stewart-Cox et al. |
| 6,026,953 | A | 2/2000 | Nakamura et al. |
| 6,132,349 | A | 10/2000 | Yokoyama |
| 6,164,444 | A | 12/2000 | Bray et al. |
| 6,237,760 | B1 | 5/2001 | Parker et al. |
| 6,478,149 | B1 | 11/2002 | Parker |
| 6,481,259 | B1 | 11/2002 | Durney |
| 6,505,735 | B1 | 1/2003 | Parker |
| 6,606,840 | B2 | 8/2003 | Focke et al. |
| 6,736,262 | B2 | 5/2004 | Focke et al. |
| 6,874,623 | B2 | 4/2005 | Bray |
| 6,877,349 | B2 | 4/2005 | Durney et al. |
| 6,974,406 | B2 | 12/2005 | Antonacci |
| 7,533,773 | B2 | 5/2009 | Aldridge et al. |
| 7,827,769 | B2 | 11/2010 | Bertuzzi et al. |
| 7,862,869 | B2 | 1/2011 | Papenfuss et al. |
| 8,091,703 | B2 | 1/2012 | Marchetti et al. |
| 8,123,030 | B2 | 2/2012 | Hein |
| 8,276,750 | B2 | 10/2012 | Biondi et al. |
| 8,418,845 | B2 | 4/2013 | Tawada et al. |
| 8,474,612 | B2 | 7/2013 | Bertuzzi et al. |
| 8,556,072 | B2 | 10/2013 | Bertuzzi et al. |
| 8,590,701 | B2 | 11/2013 | Bertuzzi et al. |
| 8,671,648 | B2 | 3/2014 | Bertuzzi et al. |
| 8,783,454 | B2 | 7/2014 | Igo |
| 8,827,145 | B2 | 9/2014 | Hultberg et al. |
| 9,033,141 | B2 | 5/2015 | Ghini et al. |
| 9,089,165 | B2 | 7/2015 | Bertuzzi et al. |
| 9,254,938 | B2 | 2/2016 | Iwata et al. |
| 9,359,124 | B2 | 6/2016 | Lutzig |
| 9,382,062 | B2 | 7/2016 | Mitten et al. |
| 9,499,331 | B2 | 11/2016 | Seyfferth De Oliveira |
| 9,533,821 | B2 | 1/2017 | Buse |
| 9,714,134 | B2 | 7/2017 | Tacchi et al. |
| 10,053,273 | B2 | 8/2018 | Petrucci et al. |
| 10,450,120 | B1 * | 10/2019 | Bellamah ..... B65D 85/1045 |
| 2003/0037586 | A1 | 2/2003 | Durney et al. |
| 2003/0047470 | A1 | 3/2003 | Parker |
| 2005/0041889 | A1 | 2/2005 | Scarberry |
| 2005/0130822 | A1 | 6/2005 | Rath |
| 2006/0011504 | A1 | 1/2006 | Gosebruch et al. |
| 2006/0021883 | A1 | 2/2006 | Focke et al. |
| 2006/0037876 | A1 | 2/2006 | Fath et al. |
| 2006/0231431 | A1 | 10/2006 | Tambo |
| 2008/0230410 | A1 | 9/2008 | Steven Jones et al. |
| 2009/0071852 | A1 | 3/2009 | Negrini |
| 2009/0177717 | A1 | 7/2009 | Meehan et al. |
| 2009/0184158 | A1 | 7/2009 | Lutzig et al. |
| 2009/0308766 | A1 | 12/2009 | Polloni et al. |
| 2010/0163563 | A1 | 7/2010 | Lutzig |
| 2011/0114518 | A1 | 5/2011 | Hein |
| 2011/0180432 | A1 | 7/2011 | Blick et al. |
| 2012/0111746 | A1 | 5/2012 | Tanbo et al. |
| 2012/0177307 | A1 | 7/2012 | Duan et al. |
| 2012/0241339 | A1 | 9/2012 | Buse et al. |
| 2012/0291401 | A1 | 11/2012 | Mitten et al. |
| 2013/0270268 | A1 * | 10/2013 | Lyzenga ..... B65D 75/5838 220/269 |
| 2014/0079343 | A1 | 3/2014 | Lyzenga et al. |
| 2014/0110286 | A1 | 4/2014 | Bertuzzi et al. |
| 2014/0374290 | A1 | 12/2014 | Seyfferth De Oliveira |
| 2015/0021219 | A1 | 1/2015 | Seyfferth De Oliveira |
| 2015/0027916 | A1 | 1/2015 | Buse |
| 2015/0034509 | A1 | 2/2015 | Seyfferth De Oliveira |
| 2015/0041346 | A1 | 2/2015 | Seyfferth De Oliveira |
| 2015/0320111 | A1 | 11/2015 | Slooff |
| 2015/0375923 | A1 | 12/2015 | Pilzecker |
| 2016/0236855 | A1 | 8/2016 | Chatelain et al. |
| 2016/0368645 | A1 | 12/2016 | Buse |
| 2017/0036835 | A1 * | 2/2017 | Duncan ..... B65D 75/5838 |
| 2017/0036849 | A1 | 2/2017 | Mitten et al. |
| 2017/0152100 | A1 | 6/2017 | Polloni et al. |
| 2017/0334634 | A1 | 11/2017 | Bray et al. |
| 2017/0341852 | A1 | 11/2017 | Bray et al. |
| 2018/0105339 | A1 | 4/2018 | Bellamah et al. |
| 2018/0111729 | A1 | 4/2018 | Koike |
| 2018/0118445 | A1 | 5/2018 | Hibbert |
| 2018/0334316 | A1 | 11/2018 | Buse |
| 2018/0354695 | A1 | 12/2018 | Bourgoin et al. |
| 2018/0362247 | A1 | 12/2018 | Slooff |
| 2019/0144197 | A1 | 5/2019 | Bourgoin et al. |

FOREIGN PATENT DOCUMENTS

| | | |
|---|---|---|
| JP | 3 210242 U | 5/2017 |
| WO | WO2008142540 | 11/2008 |
| WO | WO2013120916 | 8/2013 |
| WO | WO2014195008 | 12/2014 |
| WO | WO2016059077 | 4/2016 |
| WO | WO2016087819 | 6/2016 |
| WO | WO2016102461 | 6/2016 |
| WO | WO2017002002 | 1/2017 |
| WO | WO2018024375 A1 | 2/2018 |
| WO | WO2018059729 A1 | 4/2018 |

OTHER PUBLICATIONS

International Search Report and Written Opinion dated Apr. 23, 2018 in corresponding International Patent Application No. PCT/US2018/020127, (13 pages).

International Search Report and Written Opinion dated Feb. 14, 2018 in corresponding International Patent Application No. PCT/US2017/056272, 12 pages.

Third Party Observation mailed Nov. 16, 2018 in corresponding International Patent Application No. PCT/US2018/020127, 4 pages.

Extended European Search Report dated Feb. 28, 2020 in corresponding European Patent Application No. 19208247.7, 8 pages.

* cited by examiner

RE-SEAL LABEL AND CONTAINER WITH RE-SEAL LABEL

CROSS-REFERENCE TO RELATED APPLICATIONS

This application is a continuation patent application of U.S. patent application Ser. No. 16/193,112, filed Nov. 16, 2018, the entire content of which is incorporated herein by reference.

FIELD

The present disclosure relates to labels for packaging for consumer goods and/or packaging for consumer goods, including tobacco products such as a cigarette packs, other type of tobacco products or other type of products.

BACKGROUND

Various approaches have been made for packaging consumer goods. Known packages employ outer containers having a hinged lid providing access to an inner container with an opening for accessing consumer goods therein.

SUMMARY

Some example embodiments described herein are directed to a re-sealable label for covering an access opening of an inner box that fits within an outer box that includes a hinged lid. The re-sealable label includes a sheet of polymer material having a re-sealable adhesive on an underside thereof. A liner is adhered to the sheet of polymer material wherein the liner is configured to cover the access opening of the inner box when the hinged lid of the outer box is closed and uncover the access opening of the inner box when the hinged lid of the outer box is opened. A line of perforations in the sheet of polymer material form a fold line defining a connecting tab, and one or more of the perforations of the line of perforations include a rectilinear portion and a non-rectilinear portion.

In some example embodiments, a box in a box re-sealable container includes an outer box having a hinged lid and an inner box inside the outer box. The inner box includes an access opening which is accessible when the hinged lid of the outer box is opened. A re-sealable label includes a first zone of permanent adhesive at an upper portion of the re-sealable label on an underside of the re-sealable label, which attaches the re-sealable label at least to a back wall of the inner box. The re-sealable label includes a line of perforations defining a connecting tab at a lower portion of the re-sealable label wherein each of the perforations of the line of perforations includes a rectilinear portion and a non-rectilinear portion. The re-sealable label includes a second zone of permanent adhesive at an outer side of the connecting tab that attaches the connecting tab to an inner surface of the hinged lid of the outer box. The re-sealable label includes a zone of re-sealable adhesive on the underside of the re-sealable label that releasably attaches to a top wall and a front wall of the inner box such that a liner on the underside of the re-sealable label covers the access opening when the hinged lid is in a closed position and uncovers the access opening when the hinged lid is in an open position.

In some example embodiments, a re-sealable label for covering an opening of a box includes a sheet of polymer material having a re-sealable adhesive on an underside thereof and a liner adhered to the underside of the sheet of polymer material. The liner is configured to cover the opening and includes a foil layer and a paper layer. The re-sealable label includes a line of perforations in the sheet of polymer material wherein each of the perforations of the line of perforations includes a rectilinear portion and a non-rectilinear portion.

Some example embodiments described herein can include features described in U.S. patent application Ser. No. 15/292,913, U.S. patent application Ser. No. 15/420,862, U.S. patent application Ser. No. 15/616,450, U.S. patent application Ser. No. 15/446,789, U.S. patent application Ser. No. 15/668,822, and U.S. patent application Ser. No. 16/148,558, which are each hereby incorporated by reference herein in their entireties.

BRIEF DESCRIPTION OF THE DRAWING FIGURES

DETAILED DESCRIPTION

Reference will now be made in detail to the various embodiments, one or more examples of which are illustrated in each figure. Each example is provided by way of explanation and is not meant as a limitation. For example, features and/or method steps illustrated or described as part of one example embodiment and/or example method can be used on or in conjunction with other example embodiments and/or method steps to yield yet further example embodiments or methods. It is intended that the present disclosure includes such modifications and variations. In this specification, the word "about" is sometimes used in connection with numerical values to indicate that mathematical precision is not intended. Accordingly, where the word "about" is used with a numerical value, that numerical value should be interpreted to include a tolerance±10% of the stated numerical value. In this specification, the word "or" is used inclusively.

Example embodiments are directed to a label that can be used for a container for consumer goods. In an example embodiment of a container, the container can have a rigid inner box located within a rigid outer box. The outer box has a hinged lid that opens and closes to allow access to the inner box. The inner box has an opening for accessing the consumer goods located therein. A re-sealable label is attached to the rigid inner box and to an inner surface of the hinged lid of the rigid outer box such that the opening is covered by the re-sealable label when the hinged lid is in a closed position. The inner box has an inner liner including at least a layer of paper or other suitable material as desired. According to an embodiment disclosed herein, at least a portion of the re-sealable label can have one or more layers where an innermost layer is composed of paper. Embodiments of a re-sealable label may be used for other types of containers, including containers with only one box as opposed to an inner box and an outer box, or containers with more than two boxes.

Figure 1:
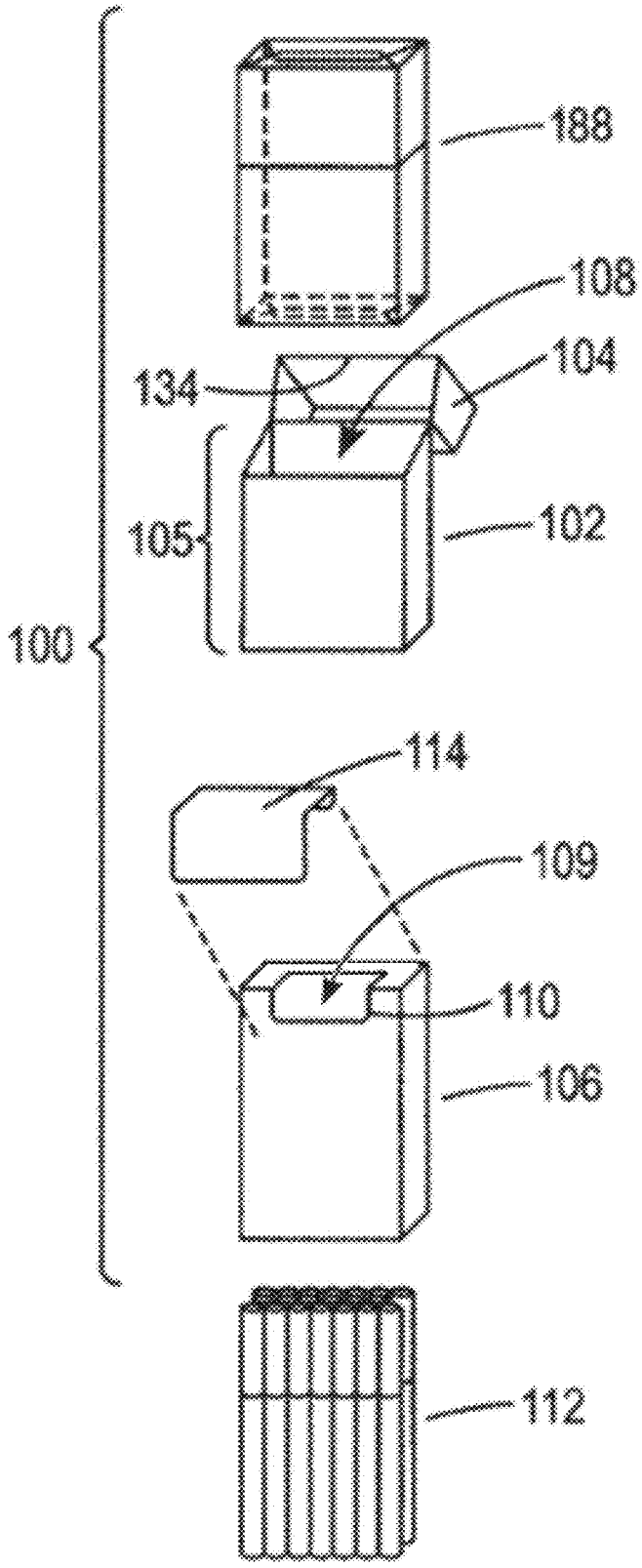
FIG. 1 illustrates an exploded view of a container for consumer goods in accordance with an example embodiment.

FIG. 1 illustrates a layout of a container 100 for consumer goods in accordance with an example embodiment. As shown in FIG. 1, container 100 includes a rigid outer box 102 having a body 105 and a hinged lid 104 configured to provide access to a rigid inner box 106 that is deposited within an inner volume 108 of the rigid outer box 102. The inner box 106 has an access opening 110 configured to provide access to consumer goods 112 stored or contained within an inner volume 109 thereof. The inner box 106 is of sufficient size to slidably and snugly fit within the inner volume 108 of the outer box 102. The inner box 106 can be securely held within the outer box 102 via contact friction between opposing surfaces of the inner box 106 and outer box 102 and/or with adhesives. A re-sealable label 114 is arranged to cover the access opening 110 of the inner box 106. When the container 100 is fully assembled, the outer box 102 can be wrapped with an outer film 188.

Figure 2:
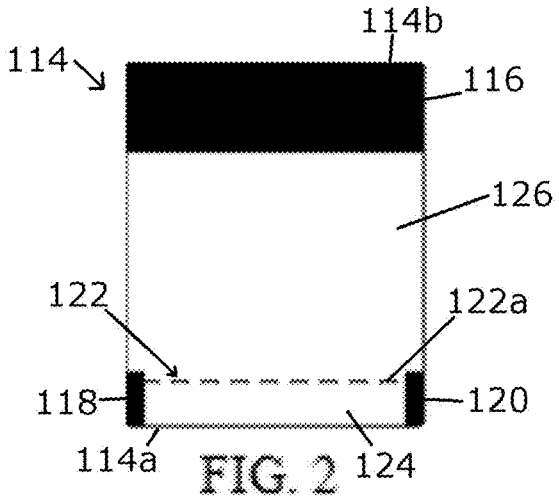
FIG. 2 illustrates a re-sealable label in accordance with an example embodiment.
Figure 3:
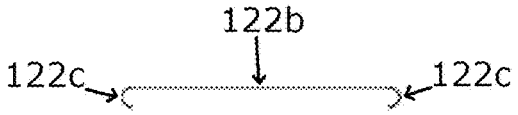
FIG. 3 illustrates a perforation of a fold line on a re-sealable label according to an example embodiment.

FIG. 2 illustrates an example embodiment of a re-sealable label 114 which includes a sheet 126 of material such as a polymer material or other suitable materials. The sheet 126 can include markings 116, 118, 120 (which in an example embodiment may be machine readable markings) and a fold line 122 (e.g., hinge line) defining a connecting tab 124 at one end of the re-sealable label 114. The fold line 122 is formed by a series of perforations 122*a*. In an example embodiment, the series of perforations 122*a* may minimize or reduce tearing of the re-sealable label 114 during opening of the hinged lid 104 as opposed to packaging with a label without said perforations 122*a*. Example embodiments include a fold line 122 formed from the series of perforations 122*a*. The perforations 122*a* can have rectilinear portions 122*b* with non-rectilinear portions 122*c* at a single end of the respective rectilinear portions 122*b*, or the perforations 122*a* can have rectilinear portions 122*b* with non-rectilinear portions 122*c* at both ends of the respective rectilinear portions 122*b*. In some example embodiments, the non-rectilinear portions 122*c* at one or both ends of the rectilinear portions 122*b* of the perforations 122*a* are configured to minimize or reduce tearing of the re-sealable label 114 by dissipating forces generated across the re-sealable label 114 when the re-sealable label 114 is unsealed and re-sealed. For example, as shown in FIG. 3, each perforation 122*a* can have a rectilinear portion 122*b* and arcuate non-rectilinear portions 122*c* at both ends of the rectilinear portion 122*b*. In an example embodiment, the arcuate non-rectilinear portions 122*c* can be half-circles. In some example embodiments, the half circles can dissipate forces across radii thereof so as to minimize tearing of the re-sealable label 114 when the re-sealable label 114 is unsealed and re-sealed.

Dimensions of an example embodiment of a re-sealable label can be as follows. The re-sealable label 114 can have a length of about 65 mm and a width of about 50 mm. A fold line 122 can extend across the width of the re-sealable label 114 and can be located about 7.5 mm from a first end 114*a* of the re-sealable label 114. The fold line 122 can include 9 perforations 122*a*. The perforations 122*a* can have lengths of about 2.7 mm with spaces of about 2.3 mm between adjacent perforations 122*a*. Each arcuate non-rectilinear portion 122*c* can have a radius of about 0.1 mm. The arcuate non-rectilinear portions 122*c* can extend towards the first end 114*a* of the re-sealable label 114. These dimensions are simply example dimensions of an example embodiment. Other dimensions may be used depending on the size of opening that a re-sealable label may cover, the box or boxes that the re-sealable label may be used with, and/or other uses that a re-sealable label may be used for.

Figure 4:
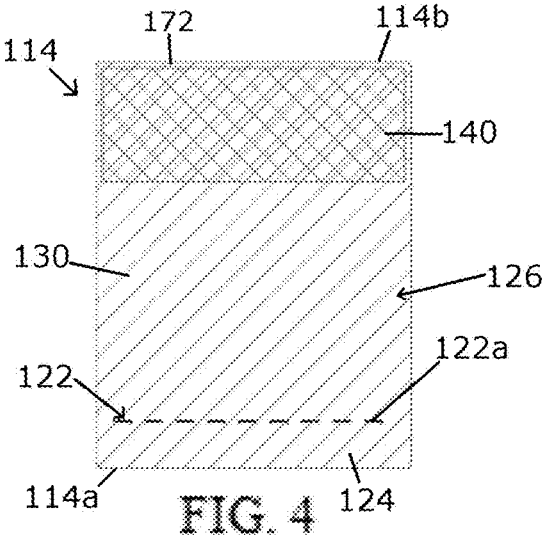
FIG. 4 illustrates an underside of a re-sealable label according to an example embodiment prior to application of a liner.

FIG. 4 illustrates an underside of a sheet 126 of a re-sealable label 114 according to an example embodiment prior to application of a paper liner. The re-sealable label 114 of the example embodiment can include a first zone of re-sealable adhesive 130 which covers, for example, about 50% or more of the underside of the re-sealable label 114. In an example embodiment, the first zone of re-sealable adhesive 130 is applied by flood coating and the first zone entirely covers the underside of the re-sealable label 114. The re-sealable label 114 can include a second zone of permanent adhesive 140 which covers, for example, about 1% to about 50% of the underside of the re-sealable label 114. In an example embodiment, the second zone of permanent adhesive 140 covers about 20% to 40% of the underside of the re-sealable label 114, or in another example the second zone of permanent adhesive 140 covers about 30% of the underside of the re-sealable label 114. Different proportions and percentages may be used in various embodiments and the examples provided herein are merely provided to explain certain examples. In an example embodiment, the second zone of permanent adhesive 140 is a rectangular area (which may have round corners) extending from a second end 114*b* of the re-sealable label 114 toward the first end 114*a*. In an example embodiment, the rectangular second zone of permanent adhesive 140 can be separated from the second end 114*b* of the re-sealable label 114 by a border 172 between the second end 114*b* and the second zone of permanent adhesive 140 that does not include permanent adhesive. The border 172 that does not include permanent adhesive can also or alternatively extend along a first side edge, a second side edge, or both the first and second side edges of the re-sealable label 114 so as to separate the second zone of permanent adhesive 140 from the first side edge, the second side edge, or both the first and second side edges (for example, in the example shown in FIG. 4, a border 172 that does not include permanent adhesive separates the second zone of permanent adhesive 140 from the second end 114*b* of the re-sealable label 114, from the first side edge of the re-sealable label 114, and from the second side edge of the re-sealable label 114). In an example embodiment, a border 172 that does not include permanent adhesive separates the second end 114*b*, the first side edge, and the second side edge of the re-sealable label 114 from the perimeter of the rectangular second zone of permanent adhesive 140 by a distance of about 1 mm. In an example embodiment, the first zone of re-sealable adhesive 130 and the second zone of permanent adhesive 140 can be created by applying re-sealable adhesive to the entire underside of a label 114, and applying permanent adhesive over a portion of the re-sealable adhesive, thereby creating a first zone of re-sealable adhesive 130 (the portion that does not have permanent adhesive over it), and a second zone of permanent adhesive 140 (the portion that has permanent adhesive over it). This, for example, can be appreciated in the example shown in FIG. 4, where slanted lines denote re-sealable adhesive, and permanent adhesive is shown applied over the slanted lines in zone 140 thereby creating second zone of permanent adhesive 140. In another example embodiment, the first zone of re-sealable adhesive 130 and the second zone of permanent adhesive 140 can be created by applying re-sealable adhesive to a first portion of the underside of a label 114, and applying permanent adhesive to a second portion of the underside of the label 114 (in an example embodiment, the second portion could be a remaining portion of the underside of the label), the first portion being the first zone of re-sealable adhesive 130 and the second portion being the second zone of permanent adhesive 140.

Figure 5:
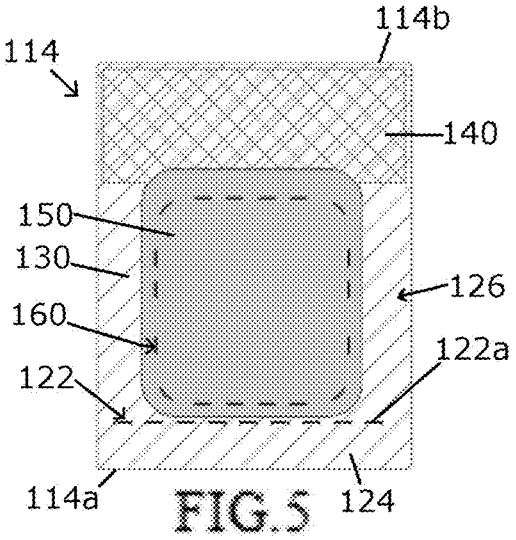
FIG. 5 illustrates the re-sealable label shown in FIG. 4 after application of a liner according to an example embodiment.

FIG. 5 illustrates the re-sealable label 114 shown in FIG. 4 after application of a liner 150 according to an example embodiment. In an example embodiment, the liner 150 includes a paper layer, and a foil layer, and the foil layer side is adhered to the re-sealable label 114. In an example embodiment, the liner 150 further includes a layer of adhesive between the paper layer and the foil layer. In an example embodiment the layer of adhesive includes silicate adhesive, but other adhesives may be used. In example embodiment, the paper layer of the liner 150 includes paper such as 19 pound paper, but other types of paper may be used. The paper layer is configured to face consumer goods 112 when label 114 is used to cover an access opening 110 for a container 100 with consumer goods 112 such as that shown in FIG. 1. In the example shown in FIG. 6, the dotted line 160 illustrates the location of an access opening 110 when the re-sealable label 114 is applied to an inner box 106 of an example embodiment. In an example embodiment, the liner 150 can be a rectangular shaped sheet (which may include rounded corners) with a width of about 34 mm and a length of about 39 mm. Other dimensions may be used for liner 150 depending on the size of the re-sealable label 114 on which the liner 150 is used, and/or the size of an opening 110 that a liner 150 may be used to cover.

Figure 6:
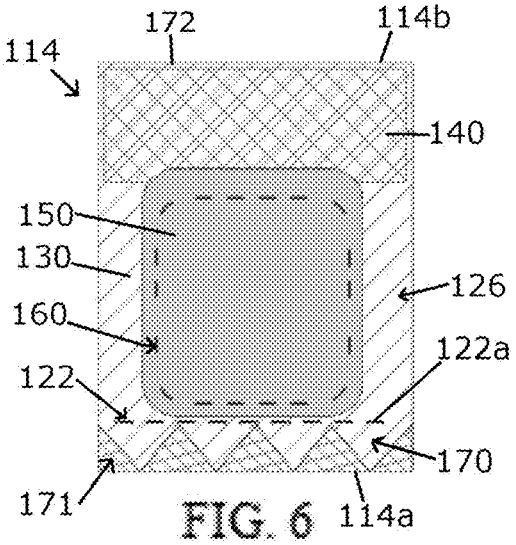
FIG. 6 illustrates a pattern of deadener on the re-sealable label shown in FIG. 5 according to an example embodiment.

FIG. 6 illustrates a pattern of deadener 171 on the re-sealable label 114 shown in FIG. 5 according to an example embodiment. In an example embodiment, the first zone of re-sealable adhesive 130 can be shaped to form a sawtooth pattern 170 by applying a pattern of adhesive deadener 171 on top of a portion of the re-sealable adhesive. In one example embodiment, the pattern of deadener 171 can include triangular portions of deadener. In an example embodiment, the re-sealable adhesive can be deadened by application of deadener at least on a portion of the re-sealable adhesive located between the fold line 122 and the first end 114*a* of the re-sealable label 114. The deadener 171 can be applied in a pattern including triangular portions such that a sawtooth pattern 170 of re-sealable adhesive 130 is formed. In an example embodiment, the deadener 171 is applied in a pattern such that the deadened area on the connecting tab 124 increases toward the first end 114*a*.

Figure 7:
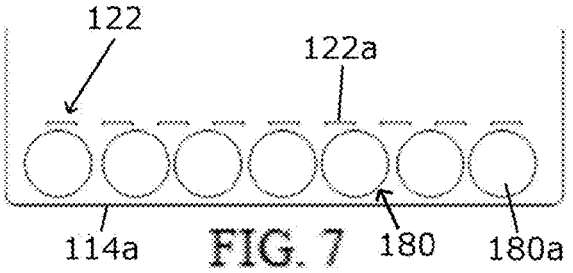
FIG. 7 illustrates a pattern of permanent adhesive applied to an outer side of a re-sealable label shown according to an example embodiment.

FIG. 7 illustrates a permanent adhesive 180 applied to an outer side of a re-sealable label 114 according to an example embodiment (the outer side of a re-sealable label is the side opposite the underside of the re-sealable label). In an example embodiment, the permanent adhesive 180 can be a series of glue dots 180*a* located on an outer side of a connecting tab 124 of a re-sealable label 114. In an example embodiment, the permanent adhesive 180 is configured to adhere a portion of the outer side of a re-sealable label 114 to an inner surface 134 of a hinged lid 104 (as shown, for example, in the examples of FIGS. 1 and 8). In an example embodiment, the permanent adhesive 180 is configured to adhere the outer side of a connecting tab 124 of a re-sealable label 114 to an inner surface 134 of a hinged lid 104.

Figure 8:
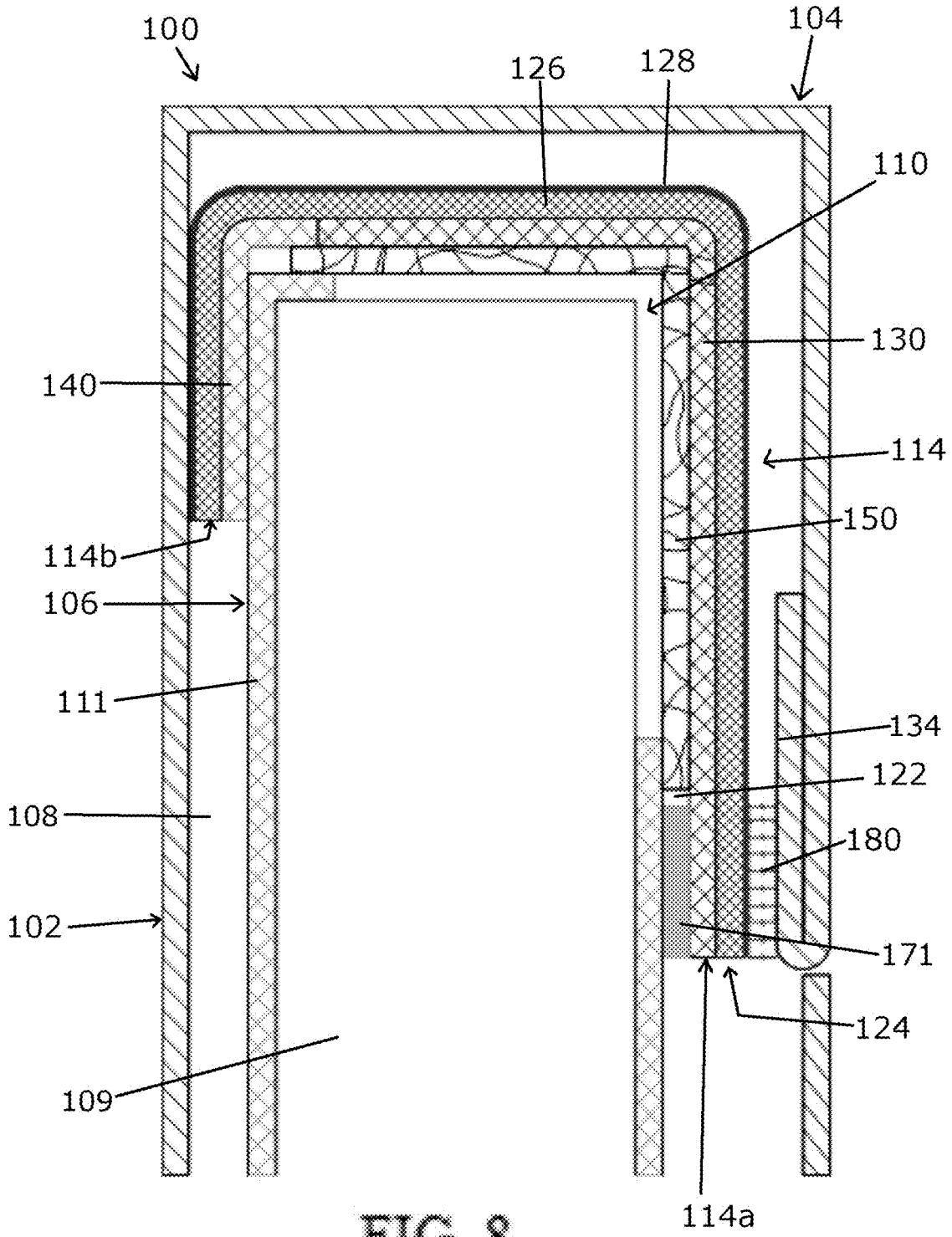
FIG. 8 illustrates a cross section of a box in box container with a re-sealable label according to an example embodiment.

FIG. 8 illustrates a cross section of a box in box container 100 with a re-sealable label 114 according to an example embodiment. The rigid inner box 106 has an inner volume 109 for consumer goods and is located within an inner volume 108 of the rigid outer box 102. The rigid outer box 102 has a hinged lid 104. The inner box 106 can include an inner paper layer, an outer paperboard layer, and a foil layer therebetween, the inner paper layer configured to be in contact with consumer goods stored therein. The outer box 102 can be made of a sheet of paperboard having panels folded and adhered to form the hinged lid 104. The re-sealable label 114 can include a rectangular shaped polymer sheet 126 (which may include rounded corners). The polymer material can include polyethylene, polyethylene terephthalate (PET), and/or other suitable materials. The re-sealable label 114 can also include in an example embodiment an outer layer 128 of ink to provide desired graphics, text and/or markings such as markings 116, 118, 120 of the example in FIG. 1. In the example embodiment shown in FIG. 8, a second zone of permanent adhesive 140 attaches an underside of the re-sealable label 114 to a back panel 111 of the inner box 106. In an example embodiment, the second zone of permanent adhesive 140 can also contact and/or attach to a rear portion of a top panel of the inner box 106 (while a gap is shown in FIG. 8 between the second zone of permanent adhesive 140 and the portion of the top panel of the inner box 106 that does not have liner 150 over it, the drawing is not to scale, including the thickness of liner 150, and in some example embodiments the second zone of permanent adhesive 140 can contact and/or attach to said portion of said top panel of the inner box 106). In an example embodiment, a pattern of permanent adhesive 180 on the outer surface of a connecting tab 124 attaches an outer surface of the connecting tab 124 to an inner surface 134 of the hinged lid 104 such that the access opening 110 of the inner box 102 may be unsealed and re-sealed by the re-sealable label 114 via movement of the hinged lid 104 of the outer box 102.

According to an example embodiment, liner 150 is configured to cover access opening 110 of inner box 106 such that an outer periphery of the liner 150 extends past the periphery of the access opening 110 when the hinged lid 104 of the outer box 102 is in a closed position (see, e.g., FIG. 5). The re-sealable label 114 of an example embodiment includes an exposed layer of re-sealable adhesive 130 that surrounds a portion or the entire access opening 110 of the inner box 106 outward of the periphery of the liner 150 (see, e.g., FIG. 5). In the example embodiment shown in FIG. 5, the exposed layer of re-sealable adhesive 130 of the re-sealable label 114 extends along three edges of the liner 150 while the second zone of permanent adhesive 140 overlies the re-sealable adhesive along the fourth edge of the liner 105. In an example embodiment, the sawtooth pattern 170 of re-sealable adhesive 130 (see, e.g., FIG. 6) having the deadener 171 promotes peeling of a re-sealable label 114 away from surfaces of the inner box 106 when the hinged lid 104 box 102 is opened to unseal the access opening 110 and/or rolling of the re-sealable label 114 over surfaces of the inner box 106 when the hinged lid 104 is closed to re-seal the access opening 110. The deadener 171 overlies portions of the re-sealable adhesive 130 of an example embodiment to render those deadener coated portions non-adhesive, forming pattern 170 of re-sealable adhesive 130 on the connecting tab 124. In an example embodiment, the pattern 170 of re-sealable adhesive 130 on the connecting tab 124 includes the deadener 171 coated thereon, and may be configured to facilitate peeling of the pattern 170 of re-sealable adhesive 130 away from the inner box 106 when the hinged lid 104 is opened.

In an example embodiment, a re-sealable label 114 can be used with a container 100 that includes an outer box 102 having the size of a traditional cigarette pack, or having a slightly larger size than a traditional cigarette pack to accommodate an inner box 106. The size of the container 100, including an outer box 102 and inner box 106 will depend on the size of the consumer goods 112.

According to an example embodiment, an outer box 102 can include paperboard with one or more optional coatings thereon. For example, the outer box 102 can include paperboard which has been embossed with a design, lettering, pattern, and/or symbol as desired and/or coated with an ink, varnish, metallization, or other suitable material for product identification. When a container 100 is fully assembled, outer box 102 can be wrapped with an outer film 188 (see FIG. 1) such as a polypropylene film with or without a tear tape that allows for tearing open outer film 188. According to an example embodiment, an inner box 106 can include a paperboard layer and an inner paper layer configured to be in contact with consumer goods that may be stored therein. A foil layer can be between the paperboard layer and the inner paper layer. Other materials may be used for an outer box and for an inner box.

In an example embodiment, a re-sealable label 114 can be used with an inner box 106 that includes a back wall, a bottom wall, a top wall, side walls, and/or a front wall, and a part of the top wall and a part of the front wall include access opening 110 (as shown, for example, in FIG. 1). In an example embodiment, re-sealable label 114 can be configured to cover opening 110, with re-sealable adhesive 130 configured to adhere to left and right portions of the top wall, and to left and right portions of the front wall. In an example embodiment, the left and right portions include portions that are to the left and right of the opening 110. In an example embodiment, the front wall may include a bottom front panel and a top front panel, and part of the top wall and part of the top front panel include access opening 110. In an example embodiment, re-sealable label 114 can be configured to cover opening 110, with re-sealable adhesive 130 configured to adhere to left and right portions of the top wall, and to left and right portions of the top front panel. In an example embodiment, the left and right portions include portions that are to the left and right of the opening 110.

In an example embodiment, a re-sealable label 114 can be used with an outer box 102 that includes a body 105 that can include a back wall, a bottom wall, a front wall, and/or side walls, and the outer box 102 can further include a hinged lid 104 that can include a top wall, a front wall, a back wall and/or side walls, and where a connecting tab 124 of the re-sealable label can be attached to an inner surface of the hinged lid 104. In an example embodiment, a connecting tab 124 of the re-sealable label can be attached to an inner surface of the front wall of the hinged lid 104.

In an example embodiment, a container 100 includes a rigid inner box 106 within a rigid outer box 102. Outer box 102 includes a hinged lid 104 for accessing the inner box 106 and the inner box 106 includes an access opening 110 for accessing consumer goods that may be located therein. The container 100 also includes a re-sealable label 114 affixed to an inner surface 134 of the hinged lid 104 of the outer box 102 via a permanent adhesive 180. When the hinged lid 104 is closed, the re-sealable label 114 is affixed to the inner box 106 via areas of permanent and re-sealable adhesives, and a liner 150 of the re-sealable label 114 covers the access opening 110 of the inner box 106. When the hinged lid 104 is open, the re-sealable label 114 is affixed to the inner box 106 via at least the area of permanent adhesive. In further example embodiments, re-sealable label 114 is configured to re-sealably adhere to a surface of the inner box 106 at least partially surrounding the access opening 110 outward of the periphery of liner 150 via the re-sealable adhesive 130.

Embodiments of a re-sealable label 114 are not limited for uses with containers 100, outer boxes 102 and/or inner boxes 106. Embodiments of a re-sealable label 114 may be used for applications other than with such containers and boxes.

Thus, it will be appreciated by those skilled in the art that the present invention can be embodied in other specific forms without departing from the spirit or essential characteristics thereof. The presently disclosed embodiments are therefore considered in all respects to be illustrative and not limiting. The scope of the invention is indicated by the appended claims rather than the foregoing description and all changes that come within the meaning and range and equivalence thereof are intended to be embraced therein.

What is claimed is:

1. A box in a box re-sealable container comprising:

an outer box including a hinged lid;

an inner box inside the outer box, the inner box including an access opening which is accessible when the hinged lid of the outer box is opened; and a re-sealable label including a first zone of permanent adhesive at an upper portion of the re-sealable label on an underside of the re-sealable label which attaches the re-sealable label at least to a back wall of the inner box, a line of perforations defining a connecting tab at a lower portion of the re-sealable label, each of the perforations of the line of perforations including a rectilinear portion and a non-rectilinear portion, a second zone of permanent adhesive at an outer side of the connecting tab that attaches the connecting tab to an inner surface of the hinged lid of the outer box, and a zone of re-sealable adhesive on the underside of the re-sealable label that releasably attaches to a top wall and a front wall of the inner box such that a liner on the underside of the re-sealable label covers the access opening when the hinged lid is in a closed position and uncovers the access opening when the hinged lid is in an open position.

2. The container of claim 1, wherein the first zone of permanent adhesive also attaches the re-sealable label to the top wall of the inner box.

3. A re-sealable label for covering an opening of a box, the re-sealable label including:

a sheet of polymer material including a re-sealable adhesive on an underside thereof;

a liner adhered to the underside of the sheet of polymer material, the liner configured to cover the opening and including a foil layer and a paper layer; and a line of perforations in the sheet of polymer material, each of the perforations of the line of perforations including a rectilinear portion and a non-rectilinear portion.

4. The re-sealable label of claim 3, wherein the sheet of polymer material further includes a zone of permanent adhesive for attaching the re-sealable label to the box.

5. The re-sealable label of claim 4, wherein the zone of permanent adhesive overlies a portion of the re-sealable adhesive.

6. The re-sealable label of claim 3, wherein the non-rectilinear portion is an arcuate portion.

7. The re-sealable label of claim 6, wherein the arcuate portion has a semi-circular shape.

8. The re-sealable label of claim 3, wherein adhesive deadener overlies one or more portions of the re-sealable adhesive.

9. The re-sealable label of claim 4, wherein the non-rectilinear portion extends away from the rectilinear portion in a direction away from the zone of permanent adhesive.

10. The re-sealable label of claim 3, further including permanent adhesive on a portion of an outer side of the re-sealable label.

11. The re-sealable label of claim 4, wherein a portion of the liner overlies a portion of the zone of permanent adhesive.

* * * * *